US006379189B2

(12) United States Patent
Sakai et al.

(10) Patent No.: US 6,379,189 B2
(45) **Date of Patent: *Apr. 30, 2002**

(54) CONNECTOR

(75) Inventors: Takashi Sakai, Sakado; Fujio Matsui, Tokyo, both of (JP)

(73) Assignee: Thomas & Betts Japan, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/159,030

(22) Filed: Sep. 23, 1998

(51) Int. Cl.[7] ..... H01R 25/00
(52) U.S. Cl. ..... 439/651; 439/638
(58) Field of Search ..... 439/651, 620, 439/686, 695, 682, 638

(56) References Cited

U.S. PATENT DOCUMENTS

| | | | | | |
|---|---|---|---|---|---|
| 3,740,697 | A | * | 6/1973 | Van Son | 439/651 |
| 3,745,515 | A | * | 7/1973 | Michaels | 439/651 |
| 4,011,398 | A | | 3/1977 | Munz et al. | 429/625 |
| 4,799,893 | A | | 1/1989 | Ogawa et al. | 439/76 |
| 5,096,427 | A | * | 3/1992 | Sadigh et al. | 439/76 |
| 5,178,114 | A | * | 1/1993 | McArthur | 439/130 |
| 5,490,785 | A | * | 2/1996 | Hein et al. | 439/620 |
| 5,551,882 | A | * | 9/1996 | Whiteman, Jr. et al. | 429/651 |
| 5,564,950 | A | * | 10/1996 | Loman et al. | 439/651 |
| 5,857,863 | A | * | 1/1999 | Onizuka et al. | 439/364 |
| 5,890,930 | A | * | 4/1999 | Gerow | 439/651 |

FOREIGN PATENT DOCUMENTS

| | | | |
|---|---|---|---|
| DE | 297 09 447 | * | 7/1997 |
| EP | 200 516 | * | 5/1986 |

* cited by examiner

*Primary Examiner*—Hien Vu
(74) *Attorney, Agent, or Firm*—Hoffmann & Baron, LLP

(57) ABSTRACT

A connector eliminates any restriction in the arrangement of connecting pins, and makes a unit to be connected compact. A male type connector assembly includes a connector body formed with a cavity portion for receiving a female type connector assembly therein. A unit mounting an electronic device thereon is hierarchically connected to the connector body. The connector body and unit of the female type connector assembly are connected together through a contact. When the male type connector assembly and the female type connector assembly are connected together, the contact is connected to a receptacle contact mounted on the female type connector assembly.

5 Claims, 17 Drawing Sheets

CONNECTOR

FIELD OF THE INVENTION

This invention relates to an electrical connector adopting hierarchical structure and more particularly to a connector, particularly of a waterproof type, for connecting a unit mounting an electronic device thereon.

BACKGROUND OF THE INVENTION

Heretofore, when for example, a unit having mounted thereon an electronic device for control (such as hybrid IC) and a wire material (wires) for signal transmission are to be connected together through a connector (particularly when they are used under severe environment in which vibrations are great and ambient temperature is high), the electronic device mounted on the unit and the connector connecting pin of the unit have been connected to each other by bonding. In such situations, the connector connecting pin and a receptacle contact in the connector terminated with the wire material (wires) have been fitted and connected together.

However, in such prior art techniques, the arrangement of bonding pads in the unit need be made into two rows for bonding. Therefore, it has been necessary to change the arrangement of the connector connecting pins of the unit to two rows in the unit even if it is in four rows to the outside.

Therefore, connecting pins of different shapes have been required and the supply and inventory of parts have become cumbersome. Also, the construction of the connector has become complicated due to the change of the arrangement of the pins. This has posed a problem in manufacture.

Further, the fact that the arrangement of the pins in the unit must be restricted to two rows requires that the necessary area occupied by the pins becomes too large. This has constituted a hindrance to make the unit compact.

SUMMARY OF THE INVENTION

Therefore, in order to solve the above-noted problems, the present invention provides a connector in which a male type connector assembly is comprised of a connector body formed with a cavity portion for receiving a female type connector assembly therein. A unit mounting an electronic device thereon is hierarchically connected to the male connector body. More particularly the connector body of the male connector assembly and the unit are connected together through a contact and when the male type connector assembly and the female type connector assembly are connected together. The contact is connected to a receptacle contact mounted on the female type connector assembly.

DETAILED DESCRIPTION OF THE PREFERRED EMBODIMENTS

FIGS. 1 to 4 show the connected state of a connector particularly of a waterproof type) according to a first embodiment of the present invention.

The illustrated connector comprises a female type connector assembly 10 and a male type connector assembly 20 connected to the female type connector assembly 10. The details of each portion will be described with reference to FIGS. 5 to 14.

Figure 1:
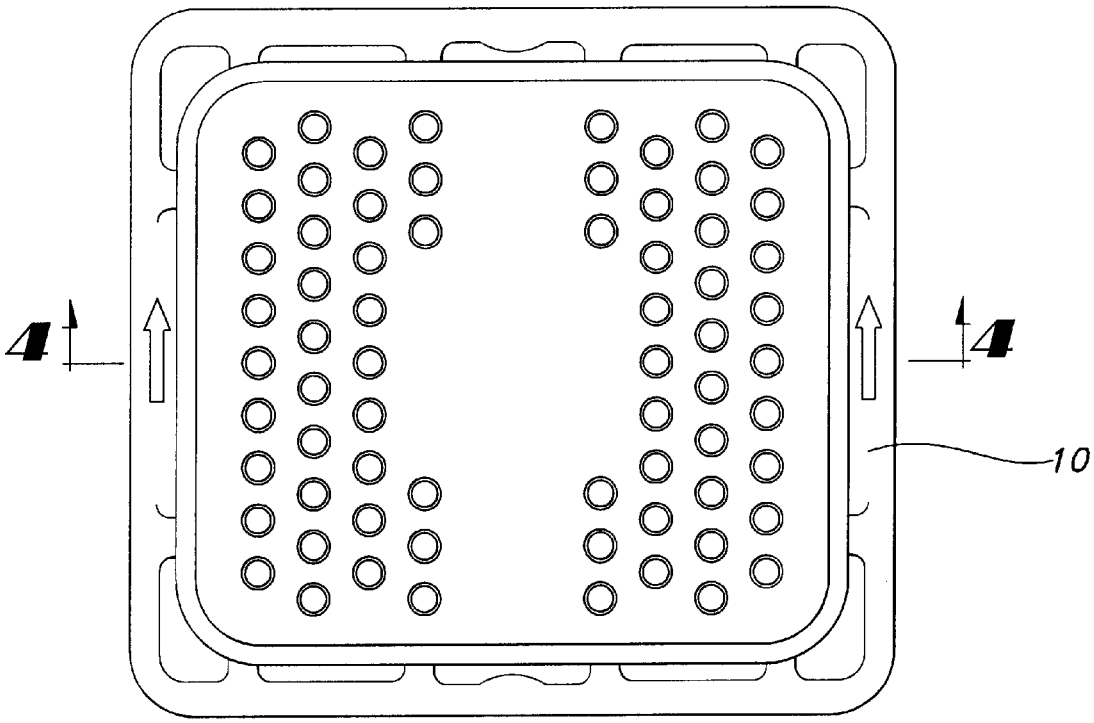
FIG. 1 is a plan view of a connector according to a first embodiment of the present invention.
Figure 2:
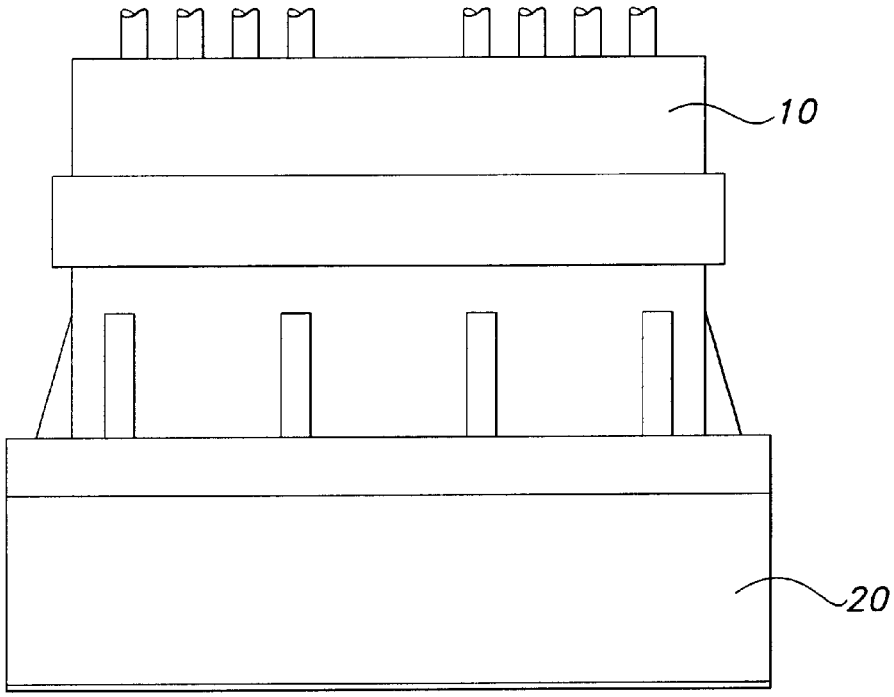
FIG. 2 is a front view of the connector shown in FIG. 1
Figure 3:
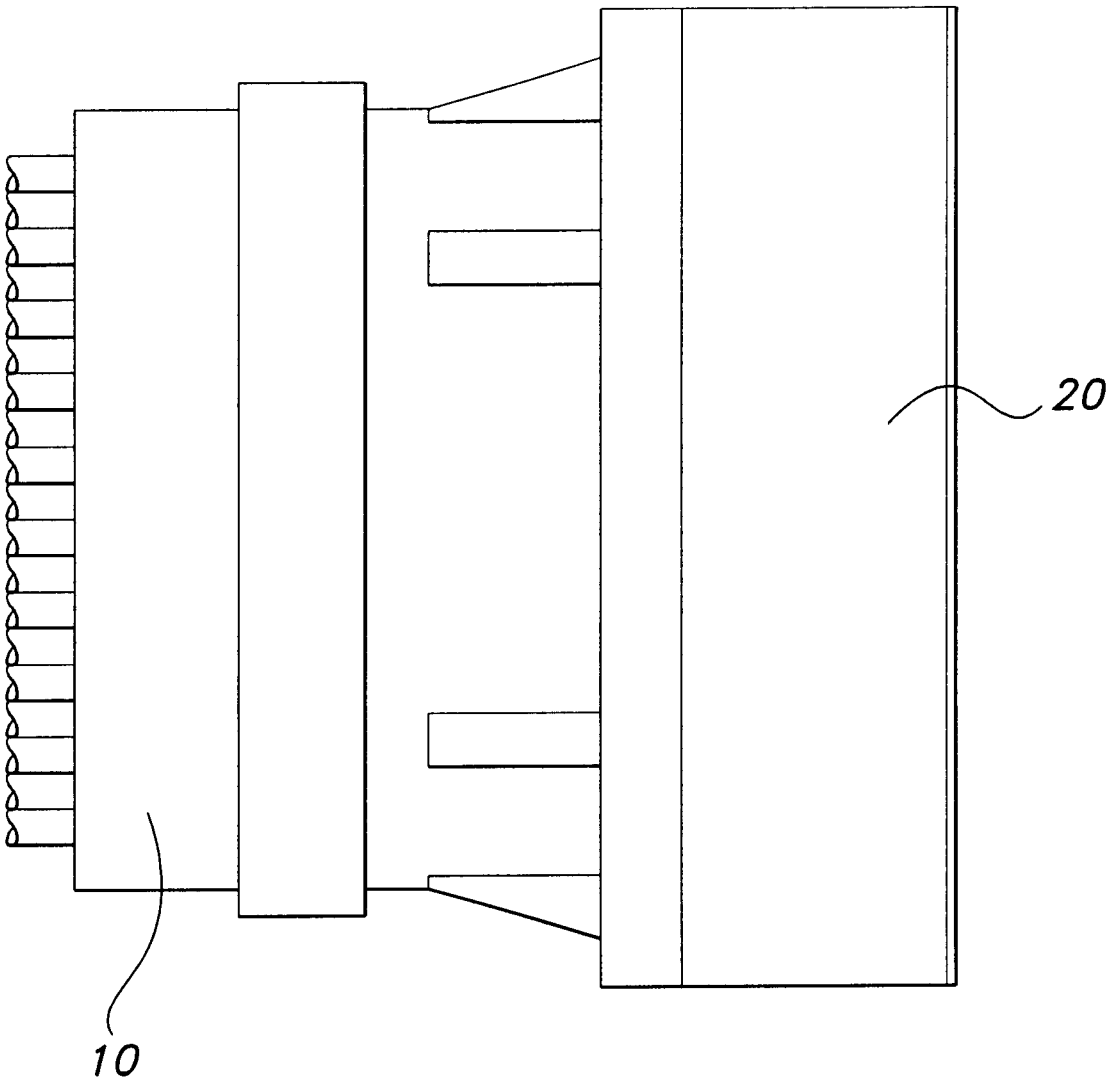
FIG. 3 is a side view of the connector shown in FIG. 1.
Figure 4:
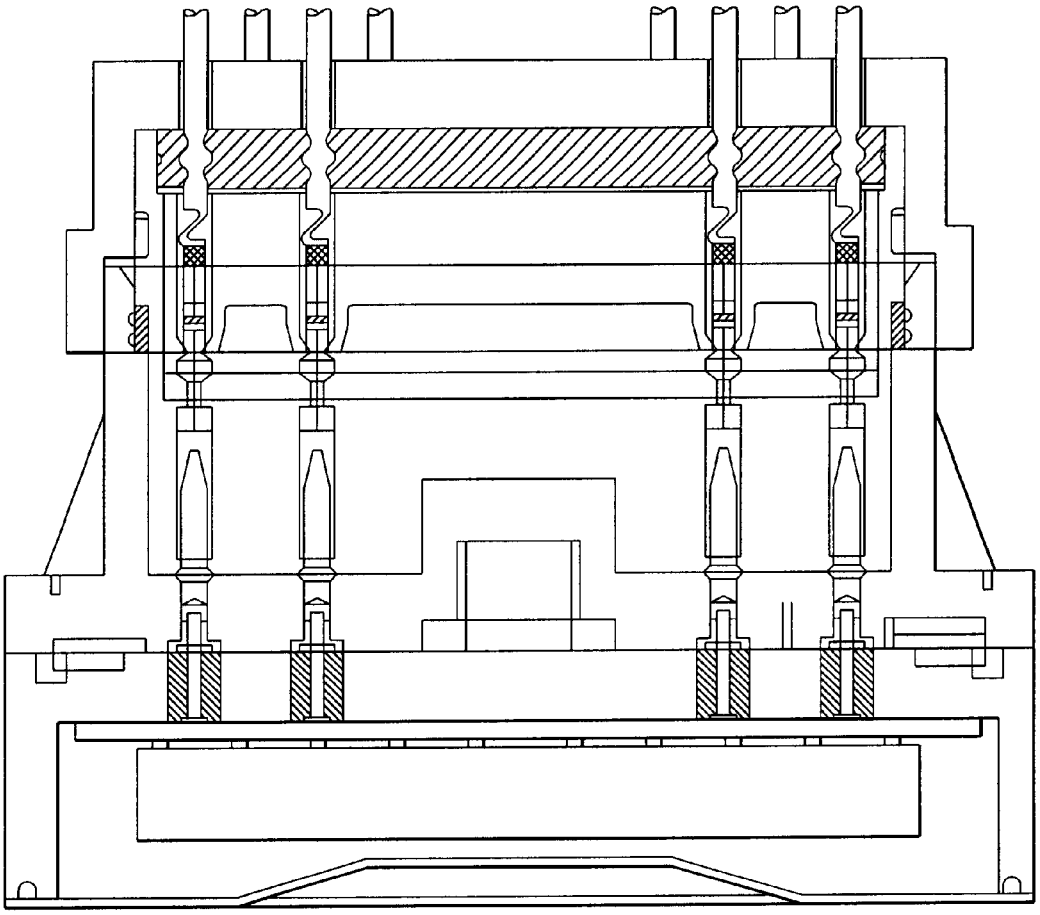
FIG. 4 is a cross-sectional view of the connector shown in FIG. 1 taken along the line A—A of FIG. 1.
Figure 5:
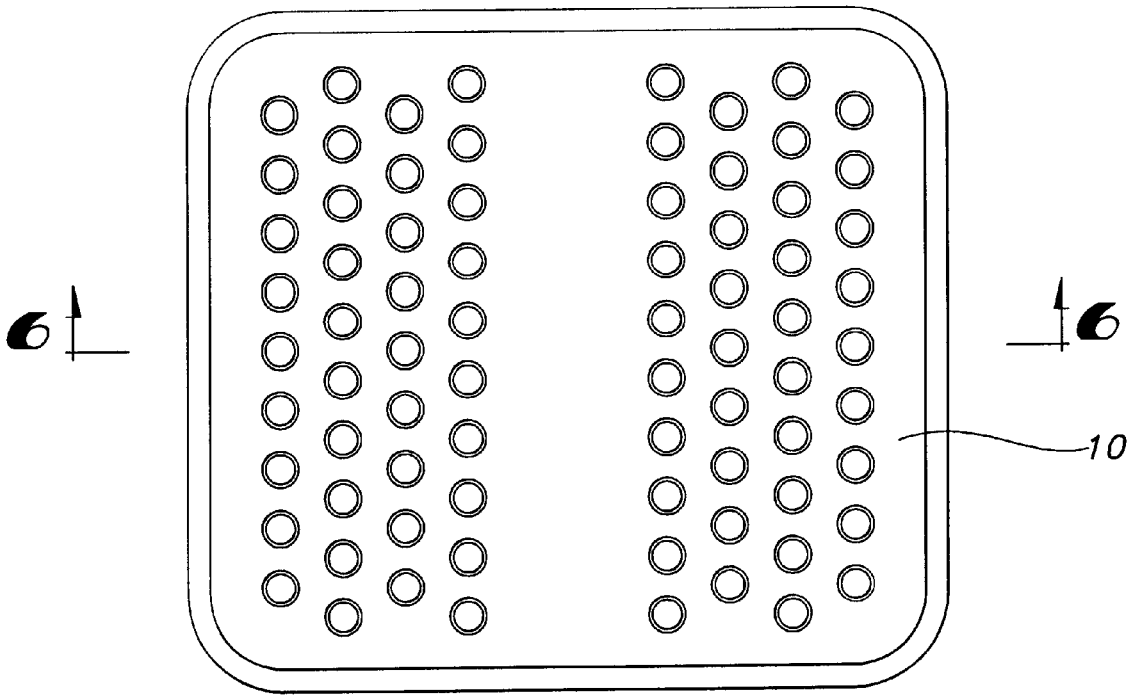
FIG. 5 is a plan view of the female type connector assembly of the connector according to the first embodiment of the present invention.
Figure 6:
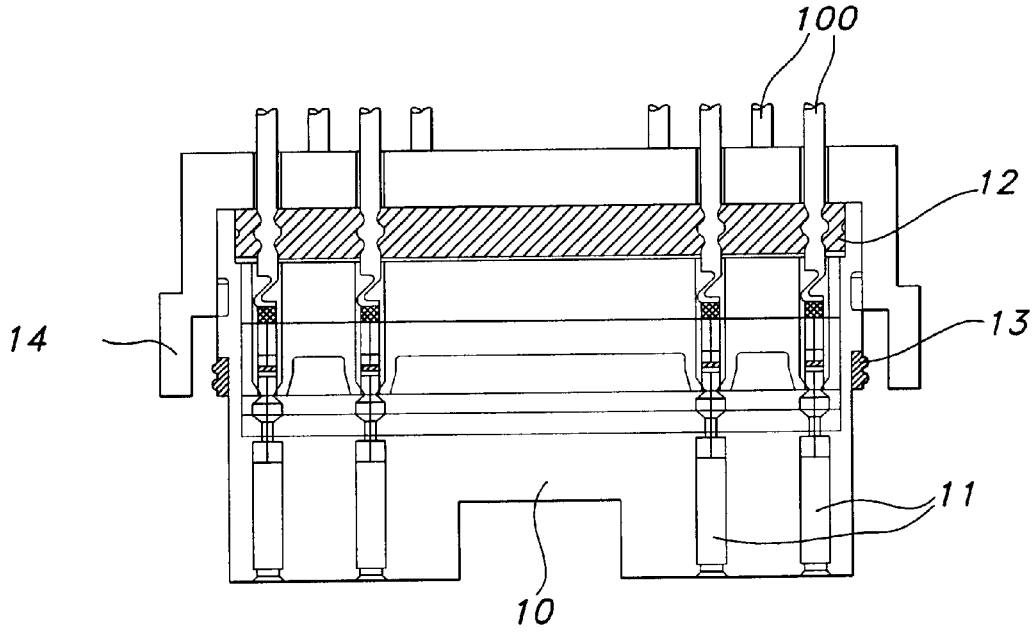
FIG. 6 is a cross-sectional view of the female type connector assembly shown in FIG. 5 taken along the line A—A of FIG. 5.

FIGS. 5 and 6 show the female type connector assembly 10. This female type connector assembly 10 has mounted in its housing, receptacle contacts 11 terminated with wire materials (wires) 100. In FIGS. 5 and 6, the reference numerals 12 and 13 designate rubber bushes, and the reference numeral 14 denotes a flange.

Figure 7:
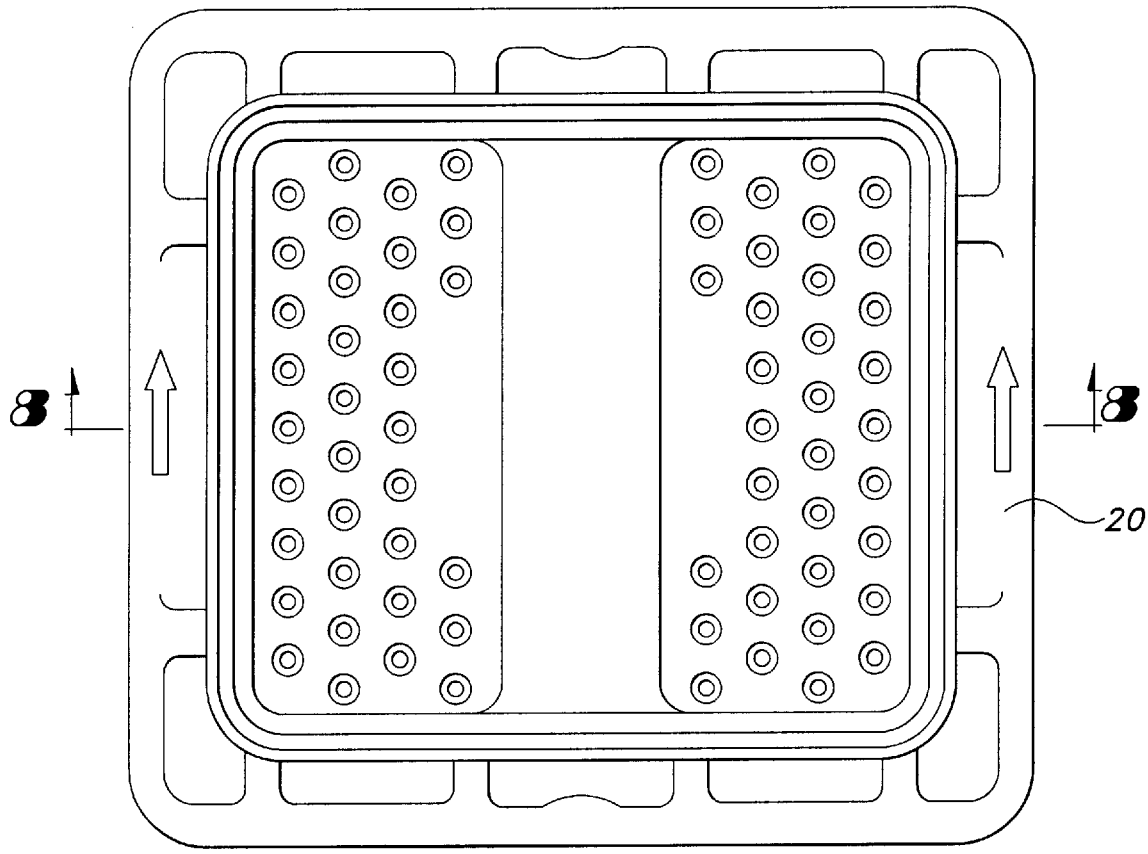
FIG. 7 is a plan view of the male type connector assembly of the connector according to the first embodiment of the present invention.
Figure 8:
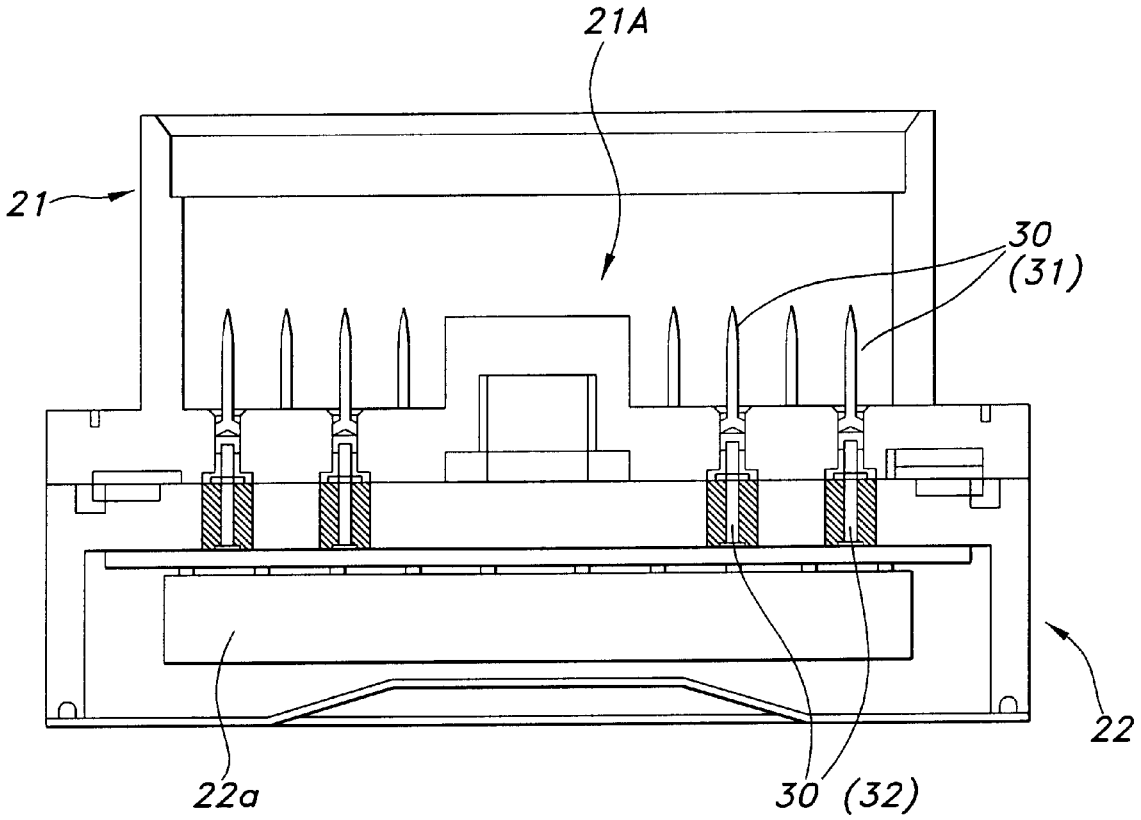
FIG. 8 is a cross-sectional view of the male type connector assembly shown in FIG. 7 taken along the line A—A of FIG. 7.

The male type connector assembly 20, as shown in FIGS. 7 and 8, comprises a connector body 21 formed with a cavity portion 21A for receiving the female type connector assembly 10 therein. A unit 22 mounting an electronic device or element (such as a hybrid IC) 22*a* thereon is hierarchically connected to the connector body 21.

The connector body 21 and unit 22 of the male type connector assembly 20 are connected together through contacts 30 (which will be described later in detail and which, in the present embodiment, are round pin contacts comprising first pin contacts 31 and second pin contacts 32). When the male type connector assembly 20 and the female type connector assembly 10 are connected together, the contacts 30 are connected to the receptacle contacts 11 mounted on the female type connector assembly 10.

Figure 9:
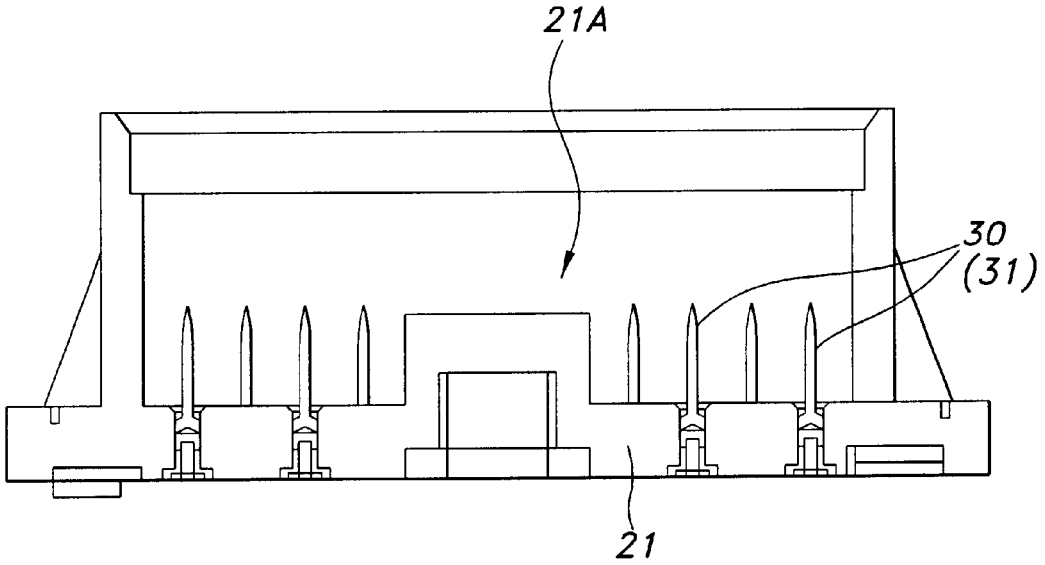
FIG. 9 is a longitudinal cross-sectional view of the connector body of the male type connector assembly of the connector according to the first embodiment of the present invention.
Figure 10:
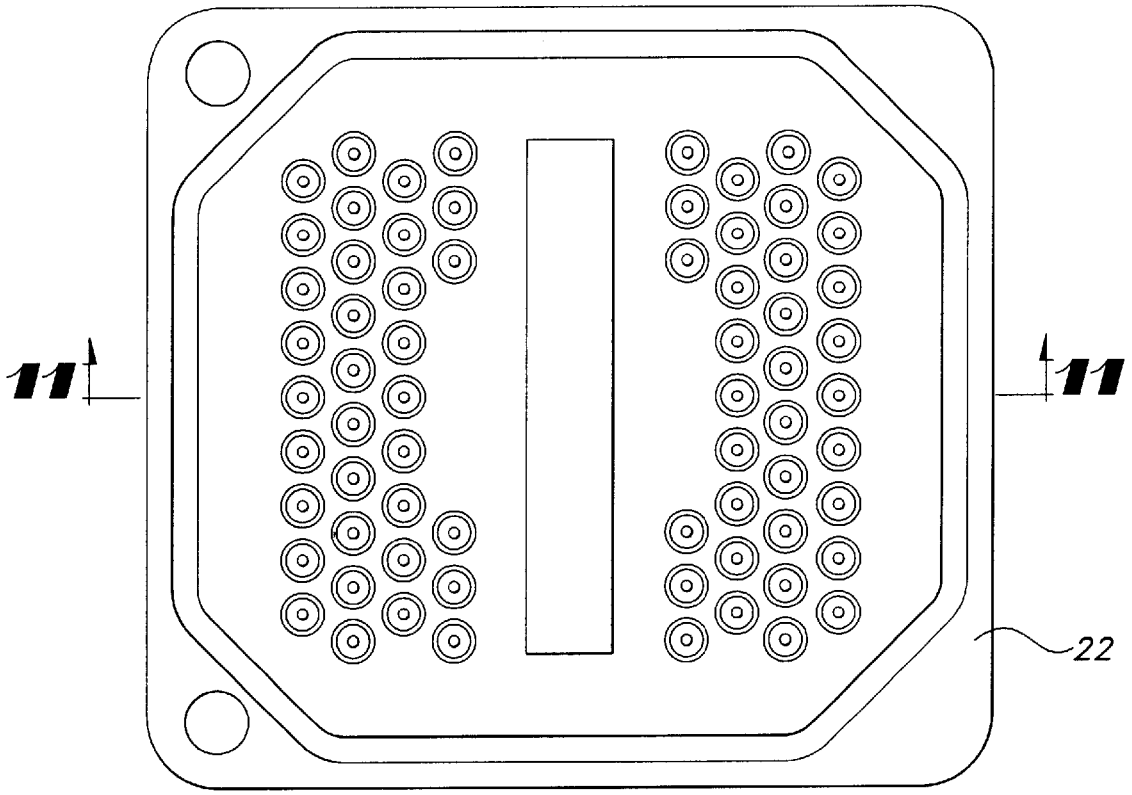
FIG. 10 is a plan view of the unit of the male type connector assembly of the connector according to the first embodiment of the present invention.
Figure 11:
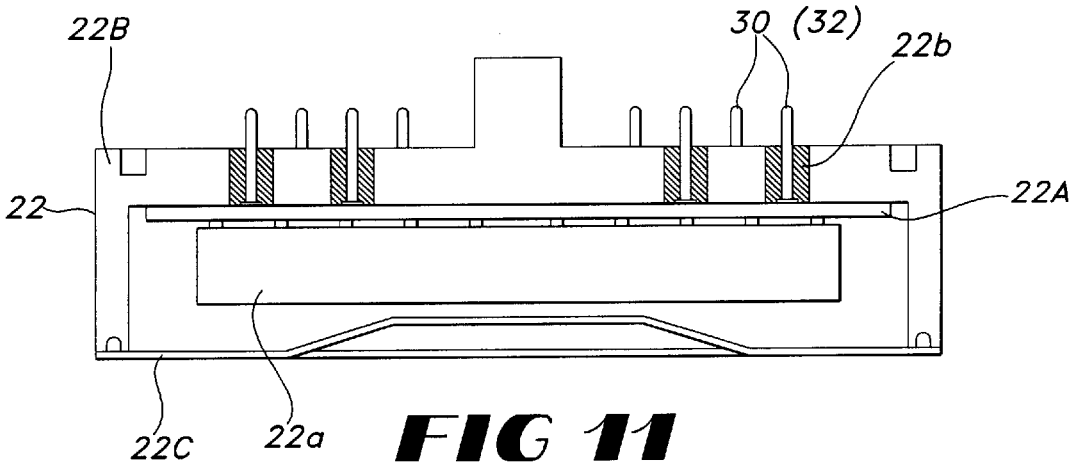
FIG. 11 is a cross-sectional view of the unit shown in FIG. 10 taken along the line A—A of FIG. 10.
Figure 12:
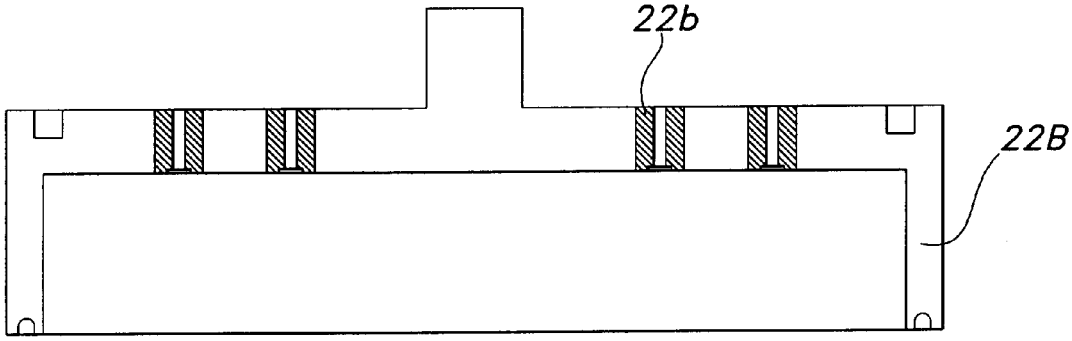
FIG. 12 is a longitudinal of cross-sectional view of the case of the unit shown in FIG. 11.
Figure 13:
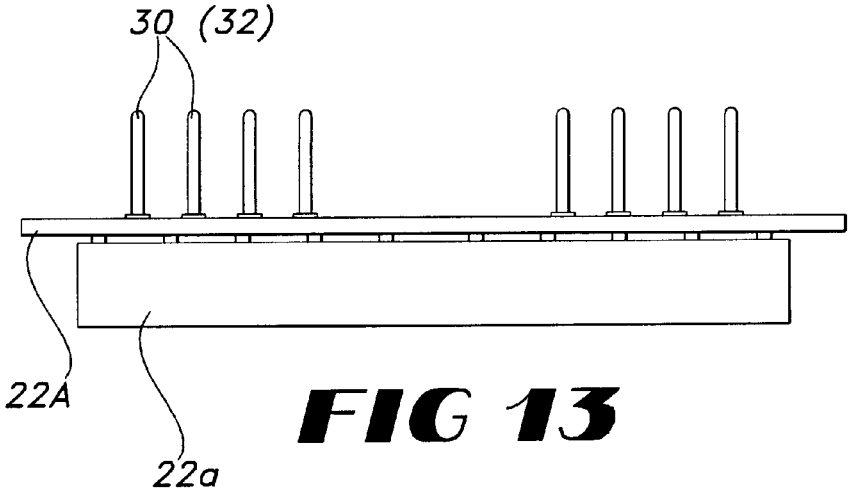
FIG. 13 is a front view of the base plate of the unit shown in FIG. 11.
Figure 14:
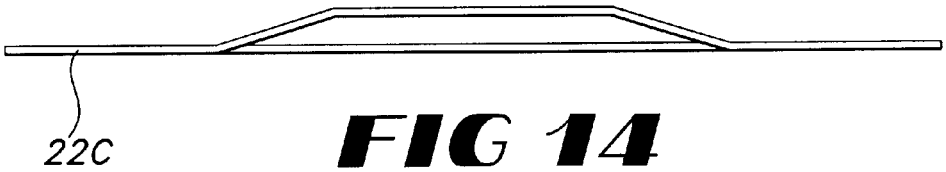
FIG. 14 is a longitudinal cross-sectional view of the lid plate of the unit shown in FIG. 11.

FIG. 9 shows the connector body 21 of the male type connector assembly 20. As shown, the contacts (the first pin contacts 31 which will be described later) are provided so as to protrude from the bottom of the cavity 21A into the cavity.

The unit 22 of the male type connector assembly 20, as shown in FIGS. 10 to 14, comprises a base plate 22A mounting the electronic device 22*a* thereon, a case 22B containing this base plate and a lid plate 22C covering this case.

The base plate 22A is, for example, a printed circuit board, and in this case, the lead and contacts (the second pin contacts 32 which will be described later) of the electronic device are placed on the electrically conductive pad of the printed circuit board directly or through other parts and are soldered thereto.

The contacts (the second pin contacts 32) are provided so as to protrude from the side opposite to the electronic device 22*a* mounted on the base plate 22A to the outside. In the illustrated embodiment, the arrangement of these contacts comprises two groups, each of which is comprised of four rows. Of course, in the present invention, the arrangement is not restricted thereto.

Also, the contacts (the second pin contacts 32) extend through through-holes formed in the case 22B containing the base plate 22A therein. In the illustrated embodiment, beads 22*b* of ferrite are embedded in these through-holes for filters.

The lid plate 22C covering the case has its middle portion made concave, and is effective to radiate heat by contacting with a heat generating element mounted on the base plate 22A when it covers the case 22B. Gel is enveloped in the unit 22 covered by this lid plate 22C to enhance moisture durability and heat preventing effects.

Figure 15:
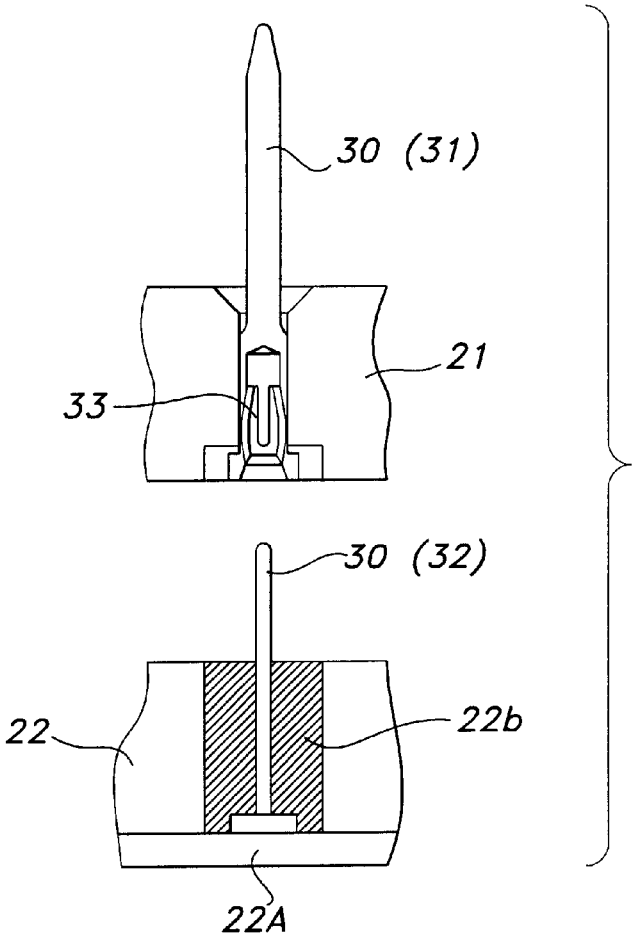
FIG. 15 is an exploded longitudinal cross-sectional view of a contact used in the male type connector assembly of the connector according to the first embodiment of the present invention.
Figure 16:
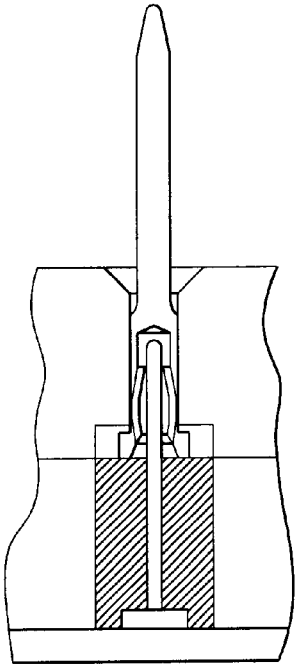
FIG. 16 is a longitudinal cross-sectional view showing the whole of the contact shown in FIG. 15.
Figure 17:
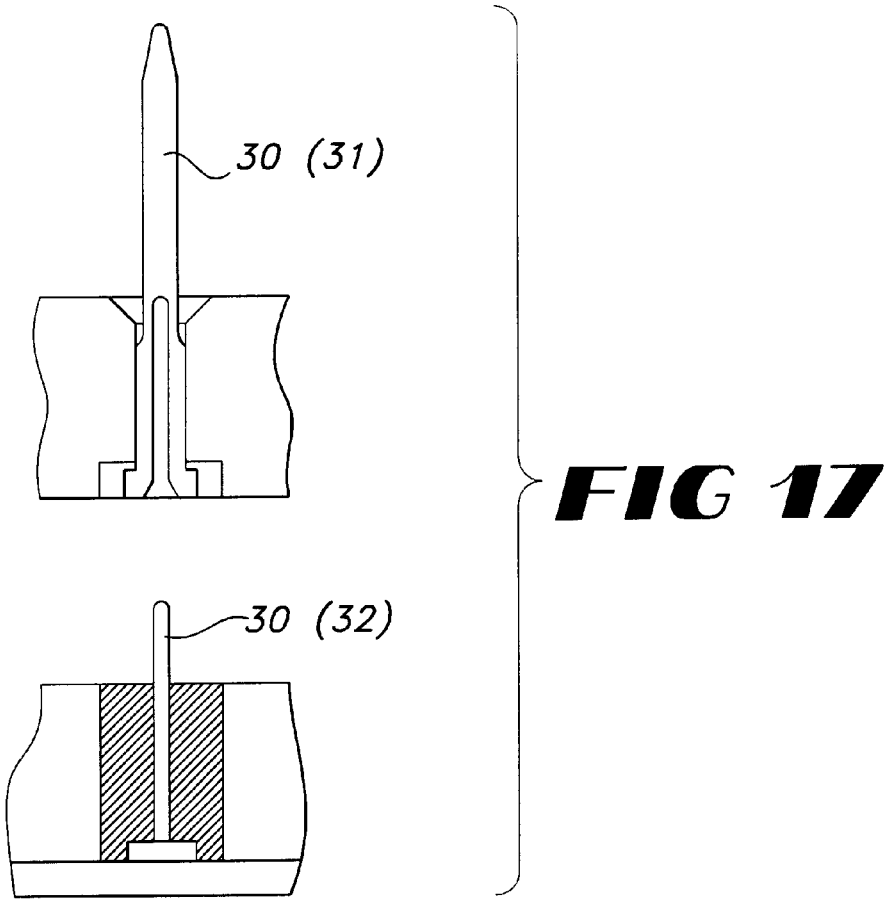
FIG. 17 is an exploded longitudinal cross-sectional view showing another example of the contact used in the male type connector assembly of the connector of the present invention.
Figure 18:
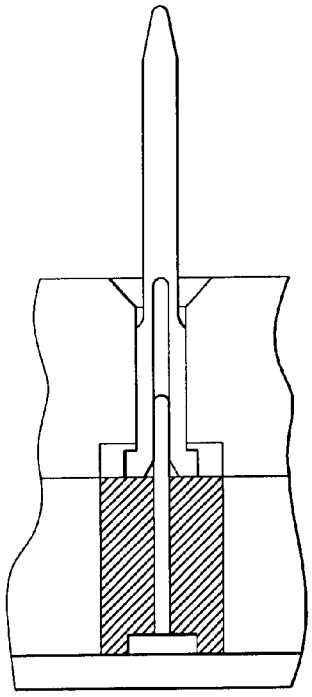
FIG. 18 is a longitudinal cross-sectional view showing the whole of the contact shown in FIG. 17.

The contact 30 of the male type connector assembly 20 will now be described in detail. A first mode of the contact 30, like the contact (the details of which are shown in FIGS. 15 and 16) used in the connector according to the above-described first embodiment, comprises a first pin contact 31 provided on the connector body 21 of the male type connector assembly 20, and a second pin contact 32 provided on the base plate 22A and extending through the case 22B to contact with the first pin contact 31. The contact in this mode has means for restraining the first and second pin contacts.

Figure 19:
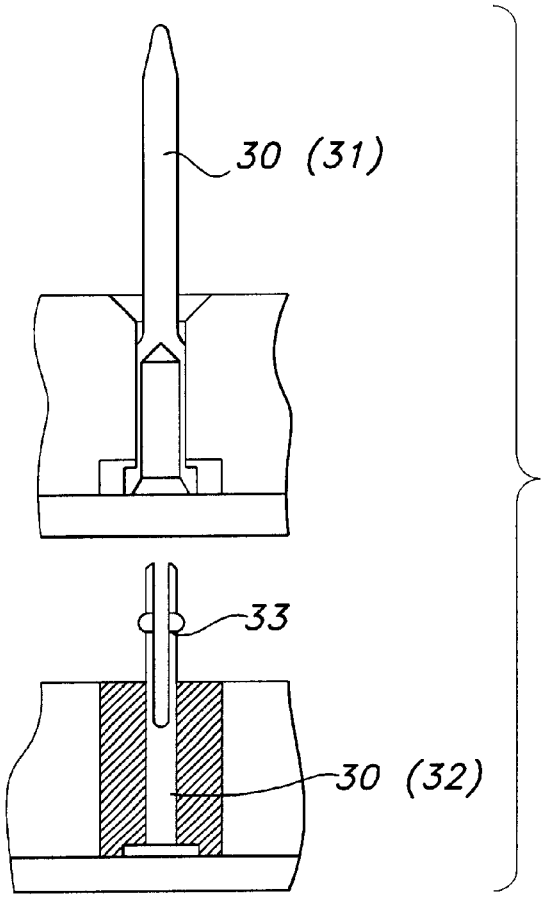
FIG. 19 is an exploded longitudinal cross-sectional view showing still another example of the contact used in the male type connector assembly of the connector of the present invention.
Figure 20:
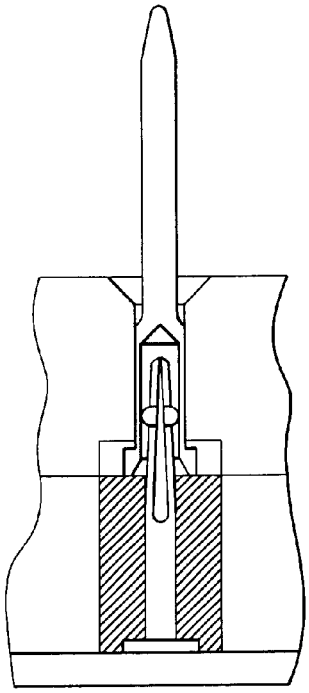
FIG. 20 is a longitudinal cross-sectional view showing the whole of the contact shown in FIG. 19.
Figure 25:
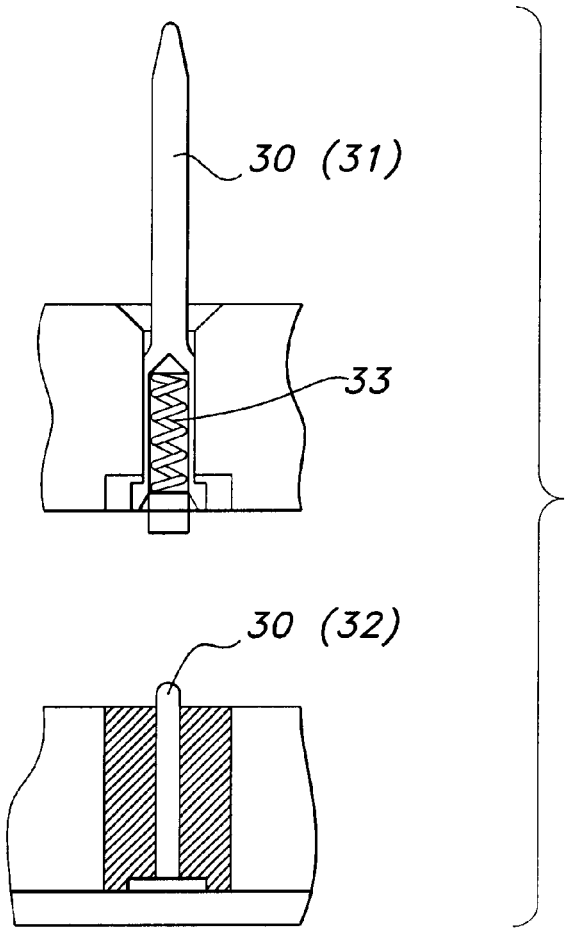
FIG. 25 is an exploded longitudinal cross-sectional view showing still a further example of the contact shown in the male type connector assembly of the connector of the present invention.
Figure 26:
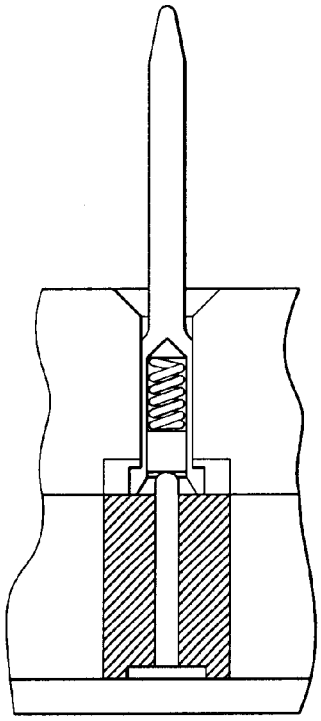
FIG. 26 is a longitudinal cross-sectional view showing the whole of the contact shown in FIG. 25.
Figure 27:
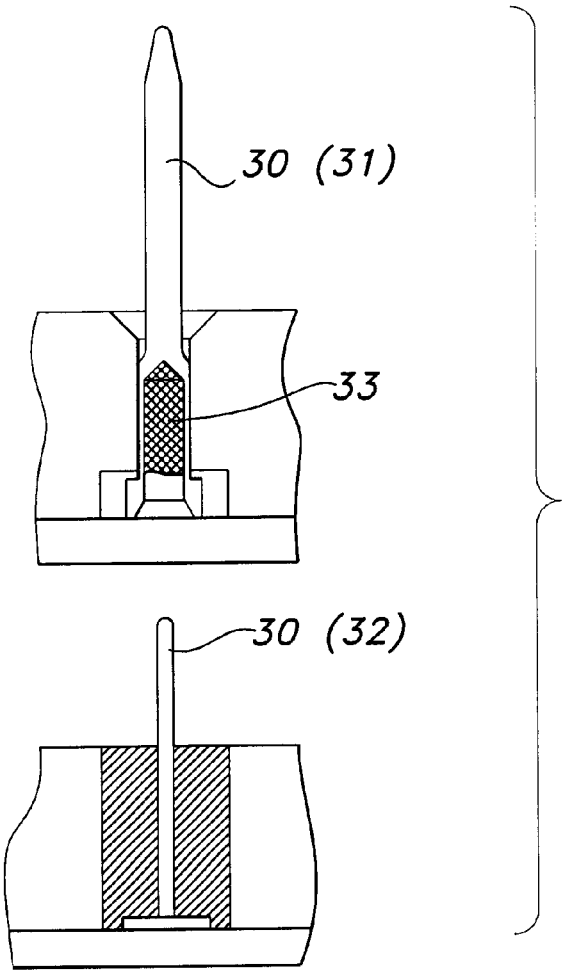
FIG. 27 is an exploded longitudinal cross-sectional view showing yet still a further example of the contact used in the male type connector assembly of the connector of the present invention.
Figure 28:
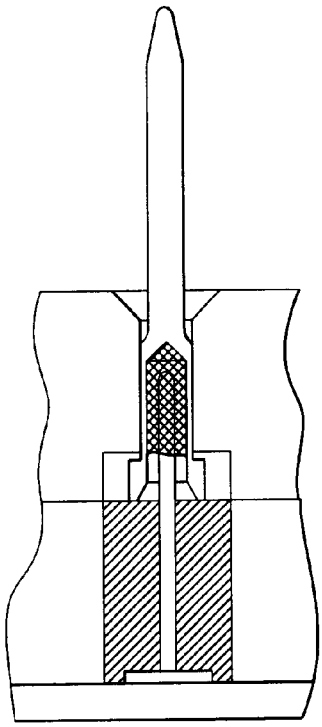
FIG. 28 is a longitudinal cross-sectional view showing the whole of the contact shown in FIG. 27.

FIGS. 17 to 32 show other examples of the contact 30. Of these examples, the examples of FIGS. 17 to 20 and FIGS. 22 to 28 correspond to the aforedescribed first mode. Of these, examples in which the restraining means, such as spring 33, is formed on the first pin contact 31 include the example of FIGS. 15 and 16 (a cylindrical and comb-like spring is fitted to the base of the first pin contact), the examples of FIGS. 17, 18, 23 and 24 (a spring is formed on the base of the first pin contact) and the example of FIGS. 25 and 26 (a coil spring is provided on the base of the first pin contact). An example in which as the restraining means, such as a spring, is formed on the second pin contact 32, is the examples of FIGS. 19 and 20 (a split is provided in the tip end of the second pin contact). Also, an example in which the first and second pin contacts are fixed (e.g. soldered) is the examples of FIGS. 27 and 28 (solder 33 is embedded into the base of the first pin contact, and is heated after the second pin contact is inserted).

Figure 21:
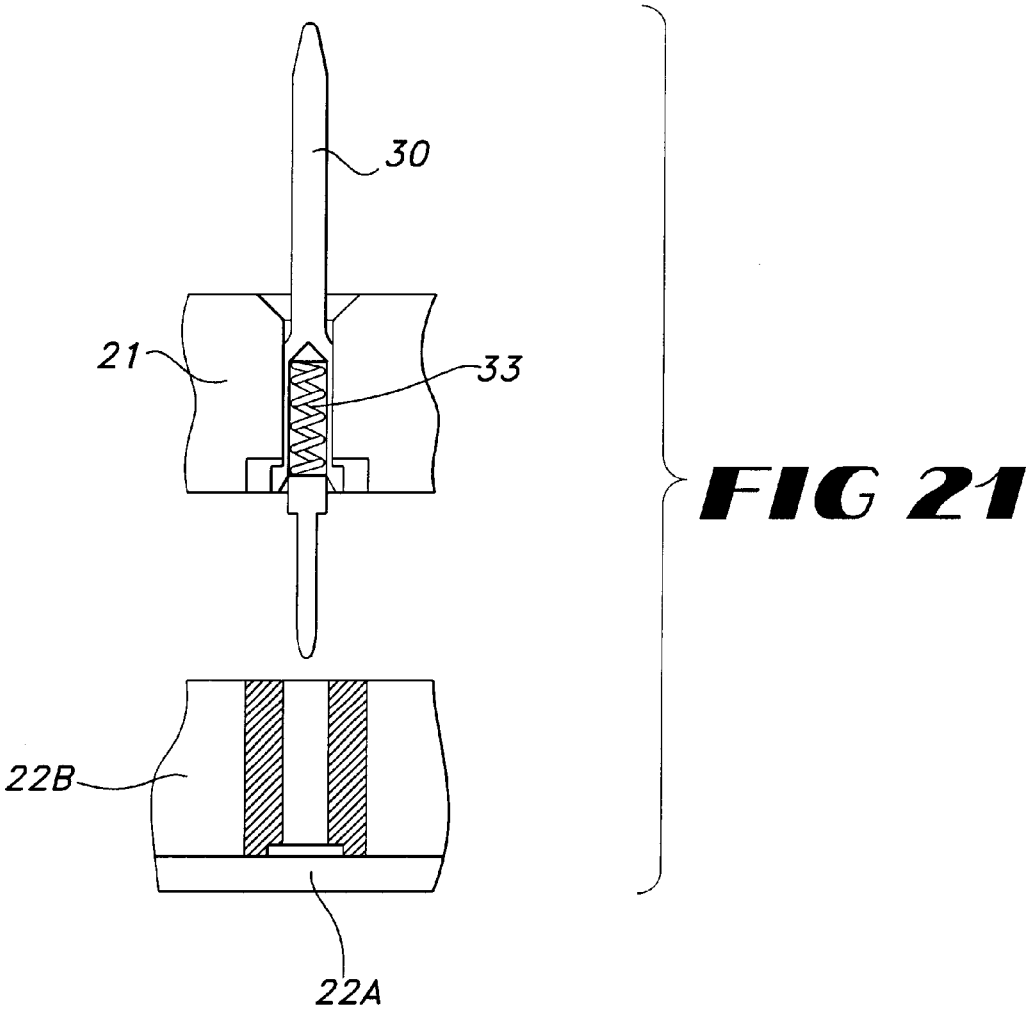
FIG. 21 is an exploded longitudinal cross-sectional view showing yet still another example of the contact used in the male type connector assembly of the connector of the present invention.
Figure 22:
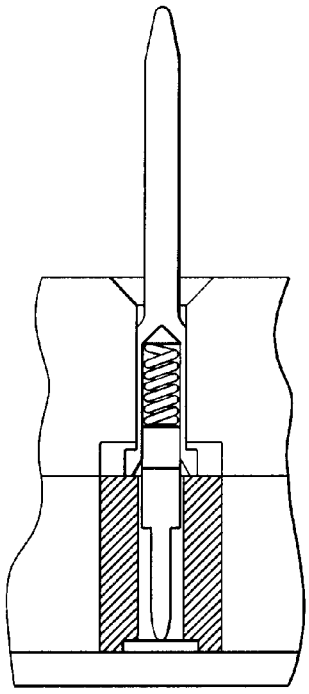
FIG. 22 is a longitudinal cross-sectional view showing the whole of the contact shown in FIG. 21.
Figure 23:
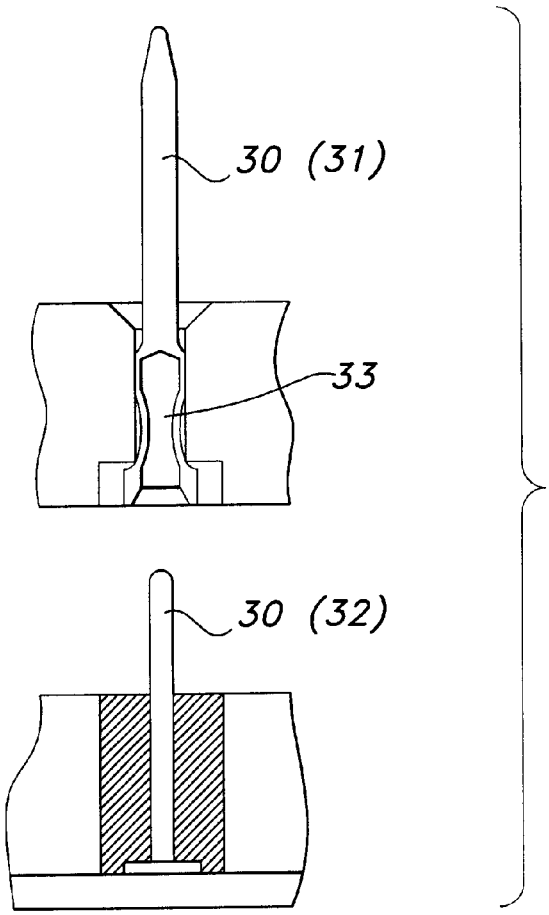
FIG. 23 is an exploded longitudinal cross-sectional view showing a further example of the contact used in the male type connector assembly of the connector of the present invention.
Figure 24:
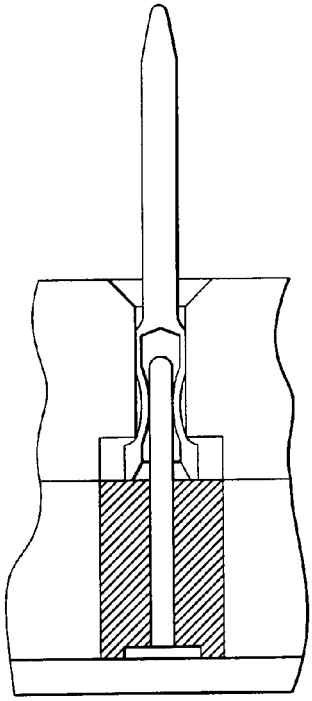
FIG. 24 is a longitudinal cross-sectional view showing the whole of the contact shown in FIG. 23.
Figure 31:
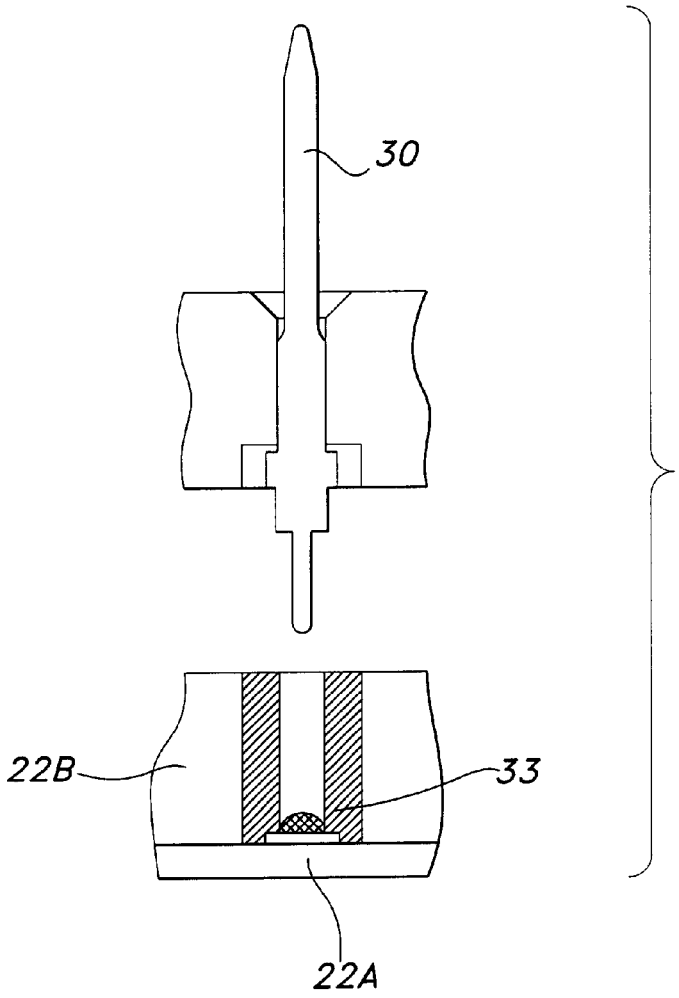
FIG. 31 is an exploded longitudinal cross-sectional view showing yet still another example of the contact used in the male type connector assembly of the connector of the present invention.
Figure 32:
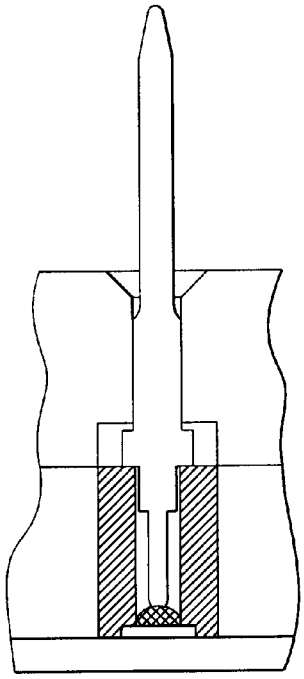
FIG. 32 is a longitudinal cross-sectional view showing the whole of the contact shown in FIG. 31.

The contacts of a second mode are of a type which is provided on the connector body 21 of the male type connector assembly 20 and protrudes also to the case 22B side of the unit 22 and extends through this case 22B to contact with the base plate 22A. Such examples are shown in FIGS. 21, 22, 31 and 32. In the example of FIGS. 21 and 22, the restraining means, a spring 33, is provided on the contact. In the example of FIGS. 31 and 32, the restraining means, solder 33, is provided on the electrically conductive pad of the base plate 22A and a pin contact is caused to extend through the case 22B and is brought into contact with the electrically conductive pad of the base plate, whereafter it is heated.

Figure 29:
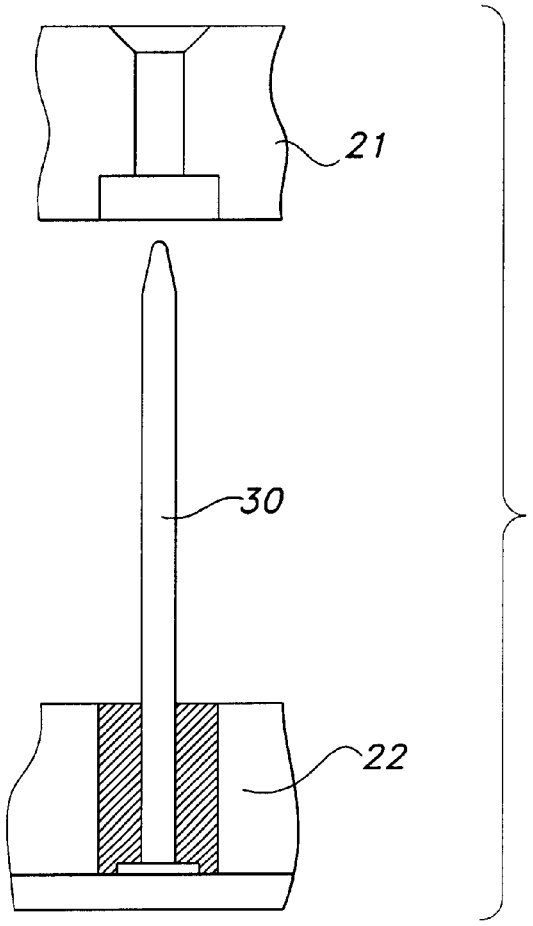
FIG. 29 is an exploded longitudinal cross-sectional view showing still another example of the contact used in the male type connector assembly of the connector of the present invention.
Figure 30:
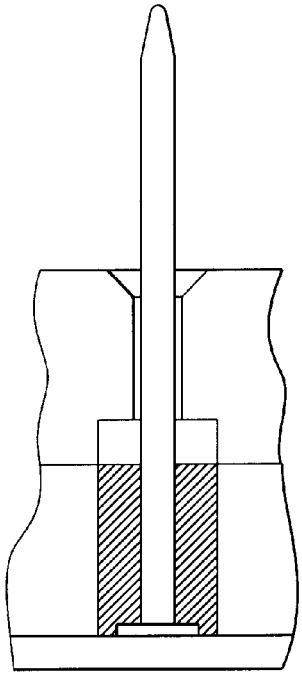
FIG. 30 is a longitudinal cross-sectional view showing the whole of the contact shown in FIG. 29.

The contact of a third mode is an example shown in FIGS. 29 and 30 wherein a contact provided in the unit 22 extends through the connector body 21 of the male type connector assembly 20 and is intactly fitted to the receptacle contact 11 of the female type connector assembly 10.

What is claimed is:

1. An electrical connector comprising:

a female type connector assembly and a male type connector assembly connected to said female connector assembly characterized in that said male connector assembly comprises a connector body formed with a cavity portion for receiving said female type connector assembly therein;

said connector body further comprising a unit having through-holes and having an electronic device mounted thereon and hierarchically connected to said connector body, when said male type connector assembly and said unit are connected together through a contact, wherein said contact is connected to a receptacle contact mounted on said female type connector assembly;

and wherein said unit further comprises a base plate positioned between said connector body and said electronic device, mounting said electronic device thereon, and a case positioned between said connector body and said base plate for containing said base plate therein;

wherein sad contact comprises a first pin contact provide on said base plate and extending through said case, and a second pin contact provided on said male type connector body and being in contact with said first pin contact, and further including means for restraining said first and second pin contacts; and wherein said unit further includes a lid plate covering said case.

2. The connector according to claim 1, characterized in that said restraining means includes a spring formed on said second pin contact.

3. The connector according to claim 1, characterized in that said restraining means includes a spring formed on said first pin contact.

4. The connector according to claim 1, characterized in that said restraining means includes means for fixing said first and second pin contact.

5. The connector according to claim 1, characterized in that said contact is provided on said male type connector body and extends through said case and contacts with said base plate.

* * * * *